US007397471B2

(12) United States Patent
Kojima et al.

(10) Patent No.: US 7,397,471 B2
(45) Date of Patent: Jul. 8, 2008

(54) LIQUID CRYSTAL DISPLAY DEVICE, POWER SUPPLY CIRCUIT, AND METHOD FOR CONTROLLING LIQUID CRYSTAL DISPLAY DEVICE

(75) Inventors: Tomokazu Kojima, Osaka (JP); Tsutomu Sakakibara, Shiga (JP); Tooru Suyama, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 755 days.

(21) Appl. No.: 10/933,411

(22) Filed: Sep. 3, 2004

(65) Prior Publication Data

US 2005/0073490 A1 Apr. 7, 2005

(30) Foreign Application Priority Data

Oct. 7, 2003 (JP) ..... 2003-347878

(51) Int. Cl.
*G09G 3/36* (2006.01)

(52) U.S. Cl. ..... 345/204; 345/87; 345/90; 345/208; 345/211; 345/212; 348/655

(58) Field of Classification Search ..... 345/87, 345/90, 204, 208, 211, 212; 348/655
See application file for complete search history.

(56) References Cited

U.S. PATENT DOCUMENTS 5,444,457 A 8/1995 Hotto
5,760,757 A * 6/1998 Tanaka et al. ..... 345/93
6,233,548 B1 * 5/2001 Schwartz et al. ..... 704/201
2002/0060536 A1 * 5/2002 Hulshof et al. ..... 315/411
2002/0149701 A1 * 10/2002 Tagomori et al. ..... 348/655
2003/0034806 A1 2/2003 Azami
2003/0034808 A1 * 2/2003 Roder et al. ..... 327/110
2003/0058213 A1 * 3/2003 Okada ..... 345/96

FOREIGN PATENT DOCUMENTS

JP 09-261461 10/1997

OTHER PUBLICATIONS

Hioki, Digital signal mean value display method; Sep. 21, 2005, JP 3696i721.*

* cited by examiner

*Primary Examiner*—Bipin Shalwala
*Assistant Examiner*—Vince E Kovalick
(74) *Attorney, Agent, or Firm*—McDermott Will & Emery LLP

(57) ABSTRACT

A liquid crystal display device according to the present invention includes: a liquid crystal panel 11; a source driver 12 for controlling the gray-scale level by applying a voltage to the liquid crystal panel 11; a DC-DC power supply 13 for driving the source driver 12 by supplying current to the source driver 12; a controller 14 for supplying a signal for controlling the gray-scale level to the source driver 12; and a variation calculator 15 for calculating the amount of change in the signal from the controller 14. In the DC-DC power supply 13, current to be supplied to the source driver 12 changes in accordance with the amount of change in the signal calculated by the variation calculator 15.

16 Claims, 8 Drawing Sheets

LIQUID CRYSTAL DISPLAY DEVICE, POWER SUPPLY CIRCUIT, AND METHOD FOR CONTROLLING LIQUID CRYSTAL DISPLAY DEVICE

The disclosure of Japanese Patent Application No. 2003-347878 filed Oct. 7, 2003 including specification, drawings and claims is incorporated herein by reference in its entirety.

BACKGROUND OF THE INVENTION

The present invention relates to liquid crystal display devices, power supply circuits for use in liquid crystal display devices or other devices, and methods for controlling liquid crystal display devices. In particular, the present invention relates to active-matrix-type liquid crystal display devices.

In recent years, liquid crystal display devices have been widely used as screens of TVs and personal computers, panels of mobile equipment, and others.

FIG. 8 is a diagram schematically showing a configuration of a conventional liquid crystal display device. Hereinafter, an active-matrix-type liquid crystal display device will be described.

As shown in FIG. 8, the conventional liquid crystal display device includes: a liquid crystal panel 101 including pixels (not shown) arranged in a matrix pattern; a source driver 102 for controlling the gray-scale levels of the pixels in the liquid crystal panel 101; and a DC-DC power supply 103 for driving the source driver 102 by supplying current to the source driver 102. Although not shown, a gate driver for switching the pixels in the liquid crystal panel 101, a controller for supplying a control signal to the source driver 102 and other components are also provided.

In the liquid crystal panel 101, liquid crystal is sandwiched between two opposed electrodes. One of the electrodes is connected to a thin film transistor (TFT) for each of the pixels. The gate of the TFT receives a voltage from the gate driver. Control of the voltage applied to the gate allows switching operation to be performed on each of the pixels. The source of the TFT receives a voltage from the source driver 102. Control of the voltage applied to the source allows the gray-scale levels of the pixels to differ from one pixel to another. The source driver 102 receives a signal from the controller and a current from the DC-DC power supply 103. A voltage from the DC-DC power supply 103 may be applied to the drain of the TFT (i.e., common electrode).

In the DC-DC power supply 103, an operational amplifier 104 for amplifying an input voltage is provided. The operational amplifier 104 may be connected to a booster (not shown). The booster is used to boost a reference voltage supplied from an external power supply and to supply the boosted voltage to the operational amplifier 104.

However, the conventional liquid crystal display device has the following drawback.

The DC-DC power supply 103 supplies a constant current Imax to the source driver 102. The amount of this current Imax is sufficient for allowing the source driver 102 to operate at the maximum output. It was believed that the supply of such a sufficient amount of current allows the liquid crystal panel 101 to display a stable image. However, in fact, a large amount of current is constantly generated irrespective of display patterns on the liquid crystal panel 101, resulting in high power consumption in the DC-DC power supply 103 and the source driver 102.

Such a drawback is common to power supplies for supplying voltages to electrodes in the liquid crystal panel 101.

SUMMARY OF THE INVENTION

It is therefore an object of the present invention to provide a liquid crystal display device exhibiting low power consumption without a loss of stability in image display by taking a means which allow the output of a power supply such as a DC-DC power supply to vary in accordance with the amount of change in display on a liquid crystal panel.

In order to achieve this object, a first inventive liquid crystal display device includes: a display section for displaying an image; a driver circuit for supplying an output signal for driving the display section; a controller circuit for supplying, to the driver circuit, a signal for controlling the output signal; a variation calculator for calculating the amount of change in the signal; and a power supply circuit for supplying, to the driver circuit, power with a value based on the amount of change in the signal.

In this device, power supplied from the power supply circuit varies depending on changes of the image on the display section. Accordingly, as compared to a conventional device in which power with a constant value is always supplied, power consumption is reduced without a loss of image quality on the display section.

The power supply circuit may adjust the amount of a current supplied to the driver circuit, in accordance with the amount of change in the signal.

A plurality of pixels may be provided in the display section, the driver circuit may apply, to the pixels, a voltage depending on the output signal, the variation calculator may calculate the amount of change in the signal for each of the pixels, and the power supply circuit may supply, to the driver circuit, a current in an amount proportional to the amount of change in the signal. In such a case, the time required for changing an image is uniform among the pixels, thus producing further stabilized displays.

A first inventive power supply circuit includes: an operational amplifier; an output transistor section including output transistors in a plurality of stages connected to an output of the operational amplifier; an I-V converter circuit including a transistor forming a current mirror together with an associated one of the output transistors; and a switching circuit for controlling an ON/OFF state of an associated one of the output transistors based on an output signal from the I-V converter circuit, the switching circuit being connected to the I-V converter circuit and the output transistor section.

In this device, the same amount of currents flow in both an output transistor and a transistor in the I-V converter circuit at an identical stage. The switching circuit controls the ON/OFF state of the output transistor in accordance with this amount, thus driving output transistors in the number associated with the number of stages necessary for allowing the current at this time to flow. That is, the number of stages of operating output transistors is adjusted at every change in display, so that power consumption is reduced without a loss of image quality.

The I-V converter circuit may further include: a resistor connected to the transistor in the I-V converter and a ground line; and an inverter section including a plurality of inverters, the inverter section having an input connected between the transistor in the I-V converter and the resistor and an output connected to the switching circuit. Then, desirable operation is achieved.

The output transistor section may include, as the output transistors: p-MIS transistors in the plurality of stages, each of the p-MIS transistors having a gate connected to the output of the operational amplifier and a source connected to a power line; and n-MIS transistors in the plurality of stages, each of the n-MIS transistors having a gate connected to the output of the operational amplifier, a drain connected to a drain of an associated one of the p-MIS transistors, and a source connected to a ground line, and the transistor in the I-V converter circuit may be a p-MIS transistor of the same size as that of an associated one of the p-MIS transistors in the output transistor section.

Alternatively, the output transistor section may include, as the output transistors: pnp bipolar transistors in the plurality of stages, each of the pnp bipolar transistors having a base connected to the output of the operational amplifier and an emitter connected to a power line; and npn bipolar transistors in the plurality of stages, each of the npn bipolar transistors having a base connected to the output of the operational amplifier, a collector connected to a collector of an associated one of the pnp bipolar transistors, and an emitter connected to a ground line, and the transistor in the I-V converter circuit may be a pnp bipolar transistor having an emitter of the same size as that of an associated one of the pnp bipolar transistors, which is at the same stage, in the output transistor section.

This power supply circuit is preferably a power supply of a liquid crystal display device.

A current source may be connected to the output transistor section. Then, current can be generated before a capacitance depending on output transistors is completely charged. Accordingly, high-speed operation is achieved.

A second inventive liquid crystal display device includes: a display section for displaying an image; a power supply circuit for supplying power for controlling the image on the display section, the power supply circuit including an operational amplifier; a comparator for comparing an output from the operational amplifier with a standard value; and a switching section for controlling an ON/OFF state of the operational amplifier based on an output signal from the comparator.

In this device, if the output from the operational amplifier is sufficiently high, the operational amplifier is temporally stopped and is not started again until the output becomes low. As a result, power consumption is reduced without a loss of image quality on the display section.

The operational amplifier may include a (+)-side input, a (−)-side input and an output, the comparator may include a (+)-side input, a (−)-side input and an output, the (+)-side input of the comparator may be connected to the output of the operational amplifier, the (−)-side input of the comparator may be connected to the (+)-side input of the operational amplifier, the output of the comparator may be connected to the switching section; and a resistor may be interposed between the (−)-side input of the comparator and the (+)-side input of the operational amplifier.

A third inventive liquid crystal display device includes: a display section for displaying an image; and a power supply circuit including an operational amplifier for supplying power for controlling the image on the display section, wherein the operational amplifier is stopped during a blanking period.

In this device, the operational amplifier is stopped only during the blanking period during which no write operation is performed on the display section whereas the operational amplifier is driven during an effective write period during which write operation is performed on the display section. As a result, power consumption is reduced without a loss of image quality on the display section.

The third liquid crystal display device may further include a controller circuit for generating a signal for controlling the image on the display section, wherein the operational amplifier is stopped during the blanking period based on the signal from the controller circuit.

It is preferable that the power supply circuit further includes a booster for boosting a voltage to be supplied to the operational amplifier, a clock signal is supplied from the controller circuit to the booster, and the frequency of the clock signal in the blanking period is lower than that in an effective write period. Then, power consumption is further reduced.

It is preferable that the display section includes an upper electrode, a lower electrode opposed to the upper electrode, a source line connected to the upper electrode, a gate line connected to the upper electrode, and a transistor connected to both the source line and the gate line, and the liquid crystal display device further includes: a source driver for driving the source line, the source driver being connected to the transistor; and a gate driver for driving the gate line, the gate driver being connected to the transistor.

In this case, the power supply circuit may supply the power to either the source driver or the gate driver.

Alternatively, the power supply circuit may supply the power to the lower electrode.

An inventive method for controlling a liquid crystal display device including a display section, a driver circuit for supplying a voltage to the display section, a controller circuit for supplying, to the driver circuit, a signal for controlling the voltage, and a power supply circuit for supplying power to the driver circuit, includes: a first step of calculating the amount of change in the signal from the controller circuit; and a second step of supplying power from the power supply circuit to the driver circuit based on the amount of change in the signal.

With this method, power supplied from the power supply circuit varies depending on changes of the image on the display section. Accordingly, as compared to a conventional method in which constant power is always supplied, power consumption is reduced without a loss of image quality on the display section.

In the second step, the amount of a current supplied to the driver circuit may be adjusted in accordance with the amount of change in the signal.

A plurality of pixels may be provided in the display section, in the first step, the amount of change in the signal may be calculated for each of the pixels, and in the second step, a current in an amount proportional to the amount of change in the signal may be supplied to the driver circuit. In such a case, the time required for changing the image is uniform among the pixels, thus obtaining further stabilized displays.

DESCRIPTION OF THE PREFERRED EMBODIMENTS

Embodiments 1

Figure 1:
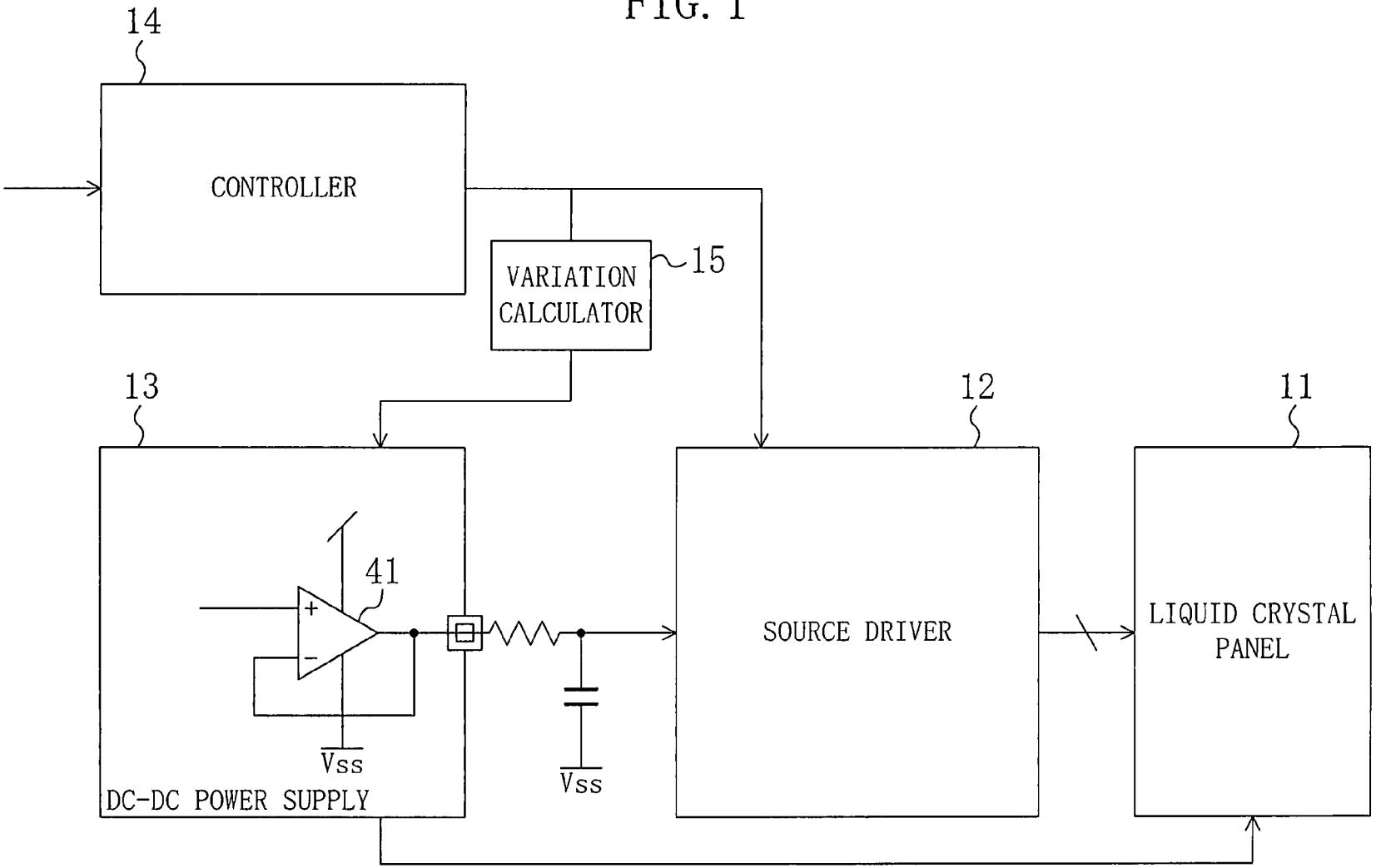
FIG. 1 is a diagram schematically showing a configuration of a liquid crystal driver according to a first embodiment.

Hereinafter, a liquid crystal driver and a method for controlling the driver according to a first embodiment of the present invention will be described with reference to the drawings. FIG. 1 is a diagram schematically showing a configuration of the liquid crystal driver of the first embodiment.

As shown in FIG. 1, the liquid crystal diver of this embodiment includes: a liquid crystal panel 11 including pixels (not shown) arranged in a matrix pattern; a source driver 12 for controlling the gray-scale levels of the respective pixels by applying a voltage to the liquid crystal panel 11; a DC-DC power supply 13 for driving the source driver 12 by supplying current to the source driver 12; a controller 14 for supplying, to the source driver 12, a signal for controlling the gray-scale levels; and a variation calculator 15 for calculating the amount of change in the signal from the controller 14.

Although not shown, in the liquid crystal panel 11, liquid crystal is sandwiched between two opposed electrodes. One of the electrodes is connected to a thin film transistor (TFT). A voltage is applied from the source driver 12 to the source of the TFT for each of the pixels.

The source driver 12 receives signals from the controller 14 and current from the DC-DC power supply 13. The signals from the controller 14 indicate the gray-scale levels of the respective pixels. Specifically, gray-scale-display bits of a signal associated with a pixel which displays white are "All Low" whereas gray-scale-display bits of a signal associated with another pixel which displays black are "All High". The source driver 12 converts these signals into voltages and applies the voltages to the liquid crystal panel 11.

The controller 14 receives a signal of image data from the outside. The controller 14 decodes the signal and supplies, to the source driver 12, signals indicating the gray-scale levels of the respective pixels in the liquid crystal panel 11 and also indicating the timings of displaying the gray-scale levels.

The variation calculator 15 calculates the amount of change in a signal supplied from the controller 14 to the source driver 12. Specifically, when a signal XN(t) for the $t^{th}$ frame (where t=1, 2, 3, . . . ) is output from the controller 14, the signal XN(t) for the $t^{th}$ frame is compared with a signal XN(t−1) for the $(t-1)^{th}$ frame which has been held beforehand, thereby calculating how much the number of bits changes between these signals. This amount of change thus obtained is supplied to the DC-DC power supply 13.

The DC-DC power supply 13 receives a signal from the variation calculator 15, determines a current necessary for changing the display on the liquid crystal panel 11 from a display in the $(t-1)^{th}$ frame to that in the $t^{th}$ frame, and supplies the current to the source driver 12.

Figure 2:
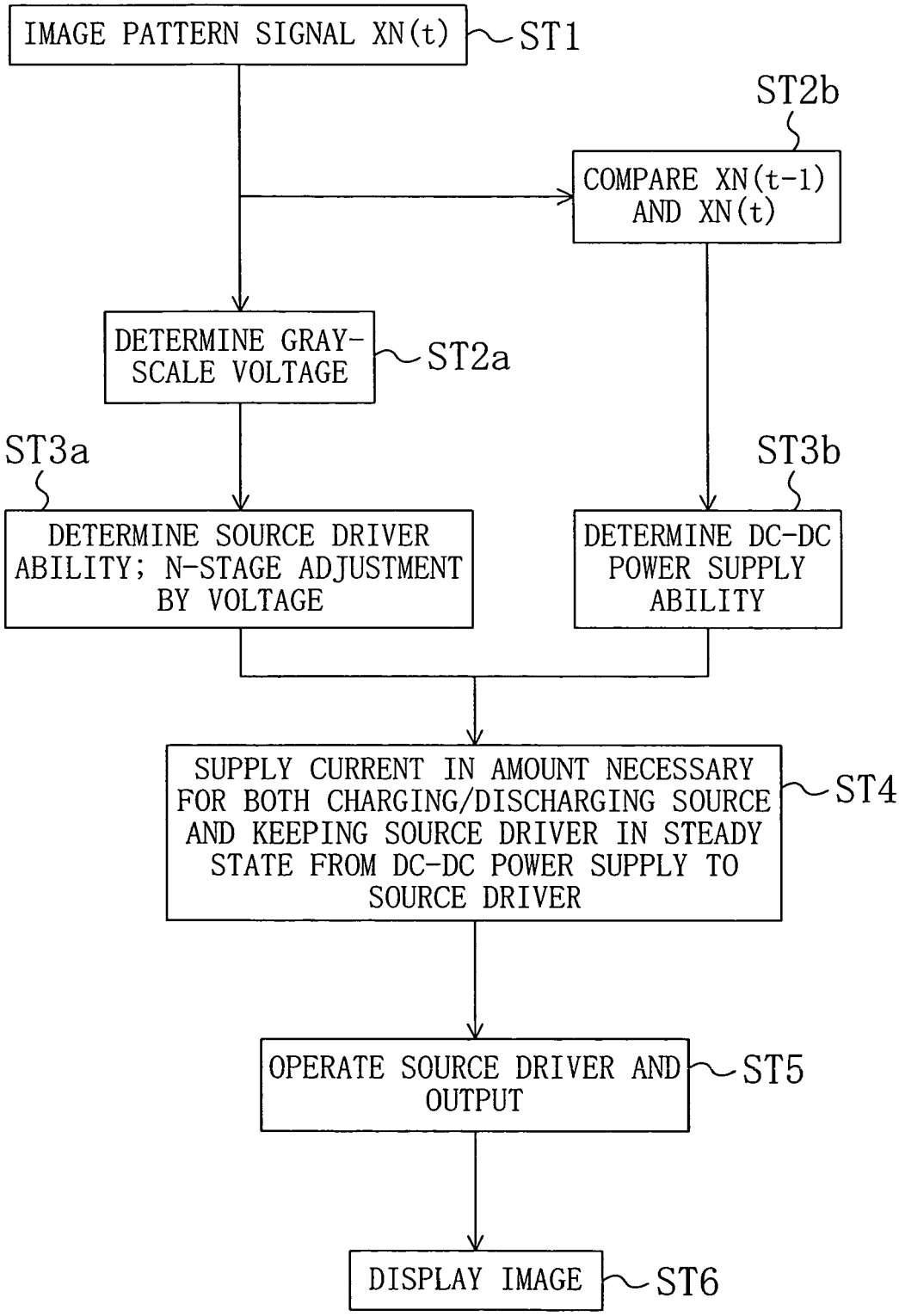
FIG. 2 is a flowchart showing steps of displaying an image on a liquid crystal panel based on a display pattern according to the first embodiment.

Now, a method for controlling the liquid crystal driver according to this embodiment will be described with reference to FIGS. 1 and 2. FIG. 2 is a flowchart showing steps of displaying an image on a liquid crystal panel based on a display pattern according to the first embodiment.

In the control method of this embodiment, as shown in FIG. 2, at step ST1, the signal XN(t) for the $t^{th}$ frame having N bits is transmitted from the controller 14. The signal XN(t) is generated by decoding image data in the controller 14.

The signal XN(t) is output to the source driver 12 and the variation calculator 15. When the signal XN(t) reaches the source driver 12, the gray-scale voltages for respective pixels are determined at step ST2*a*. Thereafter, at step ST3*a*, in the source driver 12, an ability necessary for changing the gray-scale level on the liquid crystal panel is determined for each pixel. Specifically, to change the display on the liquid crystal panel 11 from the gray-scale level in the $(t-1)^{th}$ frame to the gray-scale level in the $t^{th}$ frame, a voltage needed to be additionally applied to the liquid crystal panel 11 by the source driver 12 is determined. The liquid crystal panel 11 may include pixels whose gray-scale levels do not change. In such a case, it is sufficient to apply a voltage enough to retain the same amount of charge between the electrodes of the pixels.

On the other hand, when the signal XN(t) transmitted from the controller 14 reaches the variation calculator 15, the signal XN(t) and the signal XN(1−t) for the immediately preceding frame are compared at step ST2*b*, thereby calculating the amount of change. The signal XN(t−1) has been stored in a buffer (not shown) in the variation calculator 15 beforehand. In this case, for a comparison at the output of a signal XN(t+1) for the $(t+1)^{th}$ frame, the signal XN(t) is stored in the buffer.

Thereafter, at step ST3*b*, in the DC-DC power supply 13, an ability of the DC-DC power supply 13 necessary for driving the source driver 12 is determined based on the amount of change in a signal. Specifically, a voltage which needs to be supplied to the source driver 12 so as to change the gray-scale level on the liquid crystal panel from the $(t-1)^{th}$ frame to the $t^{th}$ frame is calculated.

Then, at step ST4, an operational amplifier 41 provided in the DC-DC power supply 13 is controlled, thereby supplying current to the source driver 12. This current includes not only an amount sufficient to charge/discharge the source driver 12 but also an amount sufficient to keep the source driver 12 in a steady state.

Subsequently, at step ST5, the source driver 12 operates.

Then, at step ST6, a display in the $t^{th}$ frame is provided on the liquid crystal panel 11.

Hereinafter, effects obtained in this embodiment will be described in comparison with a conventional device.

In the conventional device, a large constant current Imax is supplied from a DC-DC power supply to a source driver. The large current Imax herein refers to a current in an amount necessary for driving the source driver at the maximum output. Specifically, the DC-DC power supply constantly supplies a current in an amount capable of being used in such a case that the gray-scale level of every pixel changes greatly. It was believed that such a large current Imax is necessary for stabilizing the image on the liquid crystal panel.

On the other hand, in this embodiment, the variation calculator 15 calculates the amount of change of the gray-scale level for every frame. In addition, the DC-DC power supply 13 supplies, to the source driver 12, a current in an amount depending on this amount of the level change. Accordingly, if a change in a display pattern is small, power consumptions of the operational amplifier 41 in the DC-DC power supply 13 and of an operational amplifier (not shown) in the source driver 12 are reduced. On the other hand, if the change in the display pattern is large, a sufficient amount of current is supplied to the source driver 12. That is, the source driver 12 is always capable of applying a voltage with a necessary value to the liquid crystal panel 11. Therefore, in this embodiment, power consumption is reduced without a loss of image quality.

The method of calculating the amount of change in a signal as described in this embodiment is applicable to the following method.

In the liquid crystal panel 11, the time required for changing the frame is obtained by dividing charge accumulated between two electrodes in the liquid crystal panel 11 by a supplied current, as expressed by the following equation (1):

$$t=Q/I \quad \text{Equation (1)}$$

(where t is time, Q is charge, and I is current).

When the frame changes, the charge changes greatly in a pixel exhibiting a large change of its gray-scale level whereas this change of charge is small in a pixel exhibiting a small change of its gray-scale level. Accordingly, if a constant current is supplied from a DC-DC power supply to a source driver as in the conventional device, the time required for a change of the frame increases as the amount of the change of the gray-scale level increases. If this time differs among pixels, no uniform image quality is obtained.

To overcome the drawback, a method of monitoring the amount of change in a signal for controlling gray-scale level and adjusting the amount of current so as to reduce the difference in the time required for changing the frame is taken. Specifically, current in an amount proportional to the amount of change of the gray-scale level is supplied to each of the pixels. With this method, the time required for changing the frame is uniform among the pixels, thus producing further stabilized displays on the liquid crystal panel. In addition, power consumption is reduced as compared to the conventional device.

This method is applicable to the case of using any one of class-A, B and AB operational amplifiers.

Embodiment 2

Figure 3:
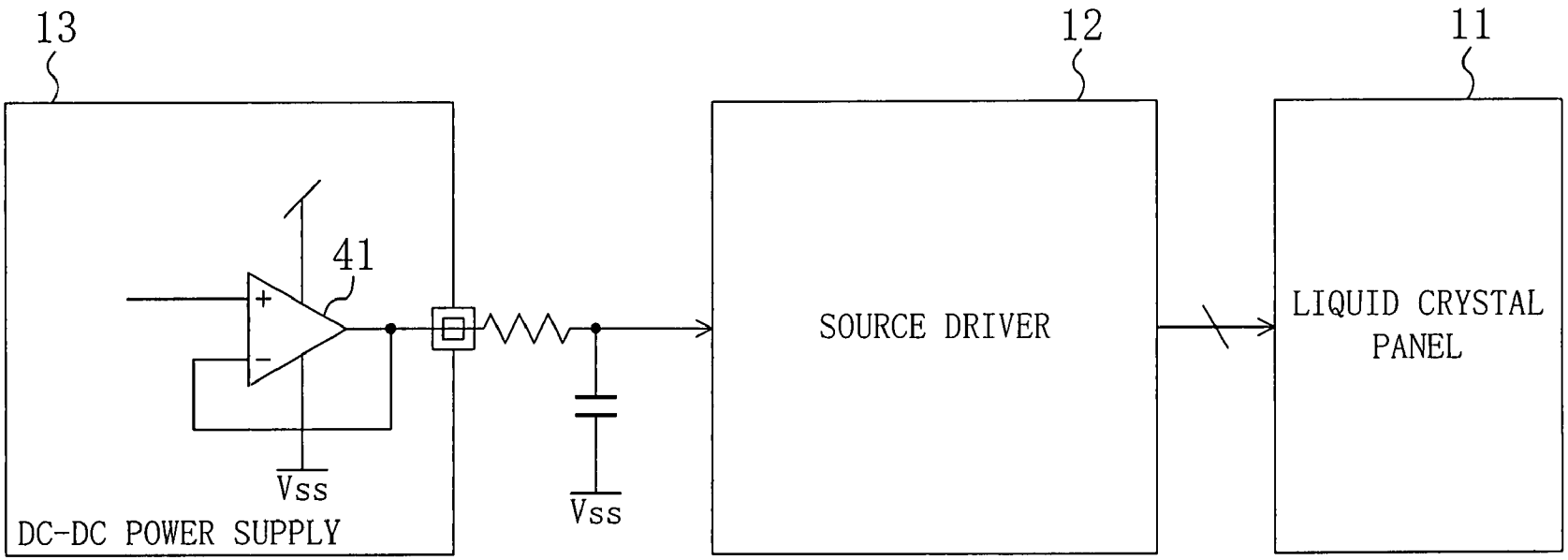
FIG. 3 is a diagram schematically showing a configuration of a liquid crystal driver according to a second embodiment.
Figure 4:
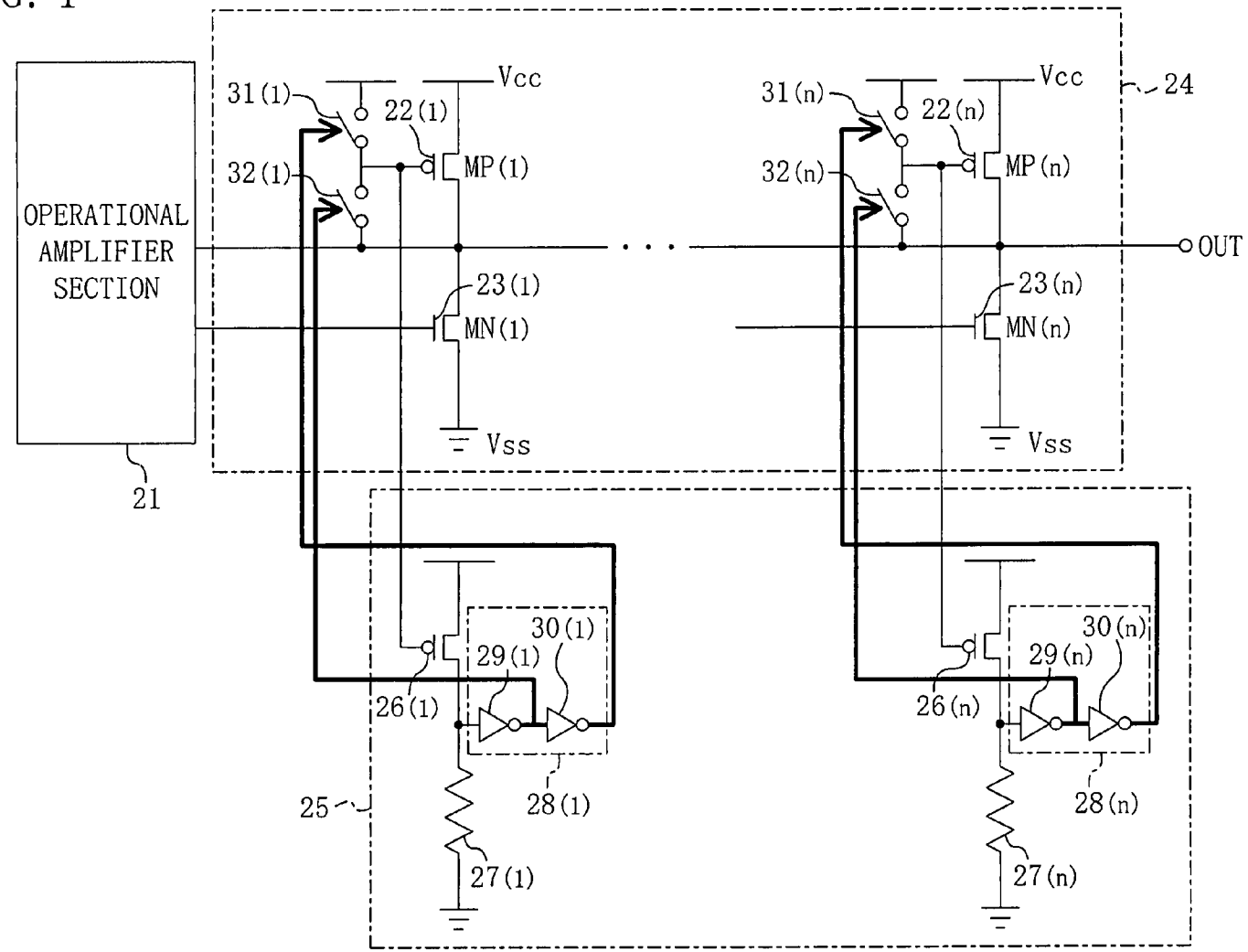
FIG. 4 is a circuit diagram specifically showing a configuration inside a DC-DC power supply of the liquid crystal driver shown in FIG. 3.

Hereinafter, a liquid crystal driver and its operation according to a second embodiment of the present invention will be described with reference to the drawings. FIG. 3 is a diagram schematically showing a configuration of the liquid crystal driver of the second embodiment. FIG. 4 is a circuit diagram specifically showing a configuration inside a DC-DC power supply of the liquid crystal driver shown in FIG. 3.

As shown in FIG. 3, the liquid crystal diver of this embodiment includes: a liquid crystal panel 11 including pixels (not shown) arranged in a matrix pattern; a source driver 12 for controlling the gray-scale levels of the respective pixels by applying a voltage to the liquid crystal panel 11; and a DC-DC power supply 13 for driving the source driver 12 by supplying current to the source driver 12.

As shown in FIG. 4, the DC-DC power supply 13 includes: an operational amplifier section 21; an output transistor section 24 which is connected to the output of the operational amplifier section 21 and in which p-MIS transistors 22(1) through 22(*n*) and n-MIS transistors 23(1) through 23(*n*) at the first through $n^{th}$ stages, respectively, are arranged in parallel; and an I-V converter section 25 including p-MIS transistors 26(1) through 26(*n*) in n stages that are respectively connected to the gates of the p-MIS transistors 22(1) through 22(*n*) in the output transistor section 24.

The operational amplifier section 21 includes an operational amplifier (not shown).

In the output transistor section 24, the gate electrodes of the p-MIS transistors 22(1) through 22(*n*) and the n-MIS transistors 23(1) through 23(*n*) in n stages are connected to the output of the operational amplifier section 21. The source electrodes of the p-MIS transistors 22(1) through 22(*n*) are connected to a power line VCC and the drain electrodes thereof are connected to the drain electrodes of the n-MIS transistors 23(1) through 23(*n*) at their respective stages. The source electrodes of the n-MIS transistors 23(1) through 23(*n*) are connected to a ground line VSS.

A transistor size W and a current $I_{DS}$ flowing between source and drain are in proportion to each other, as expressed by the following equation (2):

$$I_{DS}=(1/2)\mu C_{OX}(W/L)(V_{GS}-V_T)^2 \quad \text{Equation (2)}$$

(where μ=carrier mobility,
$C_{OX}$=gate oxide film capacitance,
W=transistor size,
L=gate length,
$V_{GS}$=gate-source voltage, and
$V_T$=threshold voltage)

Accordingly, if the size ratio among the transistors from the first stage to the $n^{th}$ stage is set at 1:2: . . . : n, the ratio of currents flowing in the respective transistors at the first through $n^{th}$ stages in the output transistor section 24 is also determined to be 1:2: . . . n.

The I-V converter section 25 is provided to control the ON/OFF states of the transistors at the respective stages in the output transistor section 24. The I-V converter section 25 includes: p-MIS transistors 26(1) through 26(*n*) having the same size as the p-MIS transistors 22(1) through 22(*n*); resistors 27(1) through 27(*n*) connected to the drains of the p-MIS transistors 26(1) through 26(*n*) at one end and to a ground line VSS at the other end; and inverter sections 28(1) through 28(*n*) in each of which two inverters are connected in series.

The gates of the p-MIS transistors 26(1) through 26(*n*) are connected to the gates of the p-MIS transistors 22(1) through. 22(*n*) at their respective stages. The p-MIS transistors 26(1) through 26(*n*) and the p-MIS transistors 22(1) through 22(*n*) form current mirrors at their respective stages. The sources of the p-MIS transistors 26(1) through 26(*n*) are connected to a power line VCC and the drains thereof are respectively connected to the resistors 27(1) through 27(*n*) and the inputs of the inverter sections 28(1) through 28(*n*).

The resistors 27(1) through 27(*n*) have resistances of VCC/(I/N), VCC/(2I/N), . . . , and VCC/(nI/N), respectively.

In each of the inverter sections 28(1) through 28(*n*), one of first inverters 29(1) through 29(*n*) and an associated one of second inverters 30(1) through 30(*n*) are connected in series. Each of the inverter sections 28(1) through 28(*n*) has its input connected between the drain electrode of an associated one of the p-MIS transistors 26(1) through 26(*n*) and an associated one of the resistors 27(1) through 27(*n*). The outputs of the first inverters 29(1) through 29(*n*) are connected to switches 32(1) through 32(*n*), respectively, and the outputs of the second inverters 30(1) through 30(*n*) are connected to switches 31(1) through 31(*n*), respectively.

Now, operation of the liquid crystal driver of this embodiment will be described with reference to FIG. 4.

In the output transistor section 24 and the I-V converter section 25, current from the operational amplifier section 21 flows in the order from the first stage to the $n^{th}$ stage. In this case, the I-V converter section 25 determines to which stage the current flows out of the first through $n^{th}$ stages, in accordance with the amount of the current.

Specifically, when current flows to a p-MIS transistor 22(*a*) and an n-MIS transistor 23(*a*) at a stage (stage a in this case) out of the first through $n^{th}$ stages, the current also flows into a p-MIS transistor 26(*a*) at stage a in the I-V converter section 25 at the same time. In this case, the p-MIS transistor 22(*a*) and the p-MIS transistor 26(*a*) have the same transistor size and act as a current mirror, so that the same amount of current flows in these two transistors. The current flowing in the p-MIS transistor 26(*a*) reaches the input of an inverter section 28(*a*). If the amount of this current is large, the input signal to a first inverter 29(*a*) in the inverter section 28(*a*) is high, the output signal from the first inverter 29(*a*) is low, and the output signal from a second inverter 30(*a*) is high. The low-level output from the first inverter 29(*a*) turns a switch 32(*a*) OFF and the high-level output from the second inverter 30(*a*) keeps a switch 31(*a*) ON, so that current constantly flows in the p-MIS transistor 22(*a*) and the n-MIS transistor 23(*a*).

On the other hand, if the amount of a current flowing into the inverter section 28(*a*) at stage a is small, the input signal to the first inverter 29(*a*) is low, the output signal from the first inverter 29(*a*) is high, and the output signal from the second inverter 30(*a*) is low. The high-level output from the first inverter 29(*a*) turns the switch 32(*a*) ON and the low-level output from the second inverter 30(*a*) turns the switch 31(*a*) OFF, so that no current flows in the p-MIS transistor 22(*a*) and the n-MIS transistor 23(*a*).

Hereinafter, effects obtained in this embodiment will be described in comparison with a conventional device.

In the conventional device, a transistor (output transistor) capable of generating high power is provided at the output of a DC-DC power supply. This transistor is always driven irrespective of a necessary amount of current. If a plurality of transistors are provided, all the transistors are driven.

On the other hand, in this embodiment, the output transistor section 24 and the I-V converter sections 25(1) through 25(*n*) are provided in the output of the DC-DC power supply to control the ON/OFF states of transistors at respective stages in the output transistor section 24. Accordingly, the amount of current supplied to the source driver is adjusted to an optimum value.

In this case, a current $I_S$ supplied to the source driver is the sum of a current consumed by the source driver itself and a current necessary for charging/discharging the liquid crystal panel. The current $I_S$ is obtained by the following equation (3) when the liquid crystal panel is charged/discharged, and otherwise obtained by the following equation (4):

$$I_S = I_{SO} + I_{PA} \quad \text{Equation (3)}$$

(where $I_S$=current needed to be supplied to the source driver,
$I_{SO}$=quiescent current of the source driver, and
$I_{PA}$=current for charging/discharging the panel)

$$I_S = I_{SO} \quad \text{Equation (4)}$$

The current $I_{PA}$ for charging/discharging the panel is expressed by the following equation (5):

$$I_{PA} = C_{SO} \times |V(t) - V(t-1)|/T \quad \text{Equation (5)}$$

(where $C_{SO}$=load capacitance on a source line,
V(t)=output voltage for the $t^{th}$ frame, and
T=convergence time)

For example, with respect to a TFT panel, the maximum value of the current $I_{PA}$ for charging/discharging the panel is about 3 to 4 mA whereas the quiescent current $I_{SO}$ of the source driver is 1 mA or less. This shows that the amount of the current $I_S$ necessary for the source driver changes greatly depending on whether the panel is charged/discharged or not. In the case of charging/discharging the panel, the value of the required charging/discharging current $I_{PA}$ changes depending on the amount of change in the display on the panel.

Accordingly, adjustment of the amount of current at every frame change as described in this embodiment enables a large reduction of power consumption. In addition, in this embodiment, current is supplied from current sources (MIS transistors) of the same type to the source driver, resulting in stable displays.

In the foregoing description, the output transistor section 24 and the I-V converter section 25 are constituted by MISFETs. Alternatively, according to the present invention, the MISFETs may be replaced with bipolar transistors. In such a case, if the output transistor section 24 is constituted by first through $n^{th}$ stages, n bipolar transistors having emitter areas each occupying one-$n^{th}$ of the total emitter area of all the transistors are provided.

Specifically, the p-MIS transistors 22(1) through 22(*n*) may be replaced with pnp bipolar transistors. In such a case, the bases of the pnp bipolar transistors are connected to the output of the operational amplifier section 21 and the emitters thereof are connected to a power line VCC. In addition, the n-MIS transistors 23(1) through 23(*n*) are replaced with npn bipolar transistors. The bases of the npn bipolar transistors are connected to the output of the operational amplifier section 21, the collectors thereof are respectively connected to the collectors of the pnp bipolar transistors, and the emitters thereof are connected to a ground line VSS.

Further, in that case, the p-MIS transistors 26(1) through 26(*n*) in the I-V converter section 25 are replaced with pnp bipolar transistors. The bases of the pnp bipolar transistors are respectively connected to the bases of the pnp bipolar transistors in the output transistor section 24. The emitters of the pnp bipolar transistors in the I-V converter section 25 and the emitters of the pnp bipolar transistors in the output transistor section 24 are set at the same size. That is, these transistors form a current mirror.

A logic signal of $I_S/n$ is supplied to the base of a bipolar transistor at the first stage and a logic signal of $(n/N)I_S(=I_S)$ is supplied to the base of a bipolar transistor at the $n^{th}$ stage. In the case of using bipolar transistors in such a manner, the same effects are obtained as in the case of using MIS transistors.

This embodiment is applicable to the case of using any one of class-A, B and AB operational amplifiers.

Embodiment 3

Figure 5:
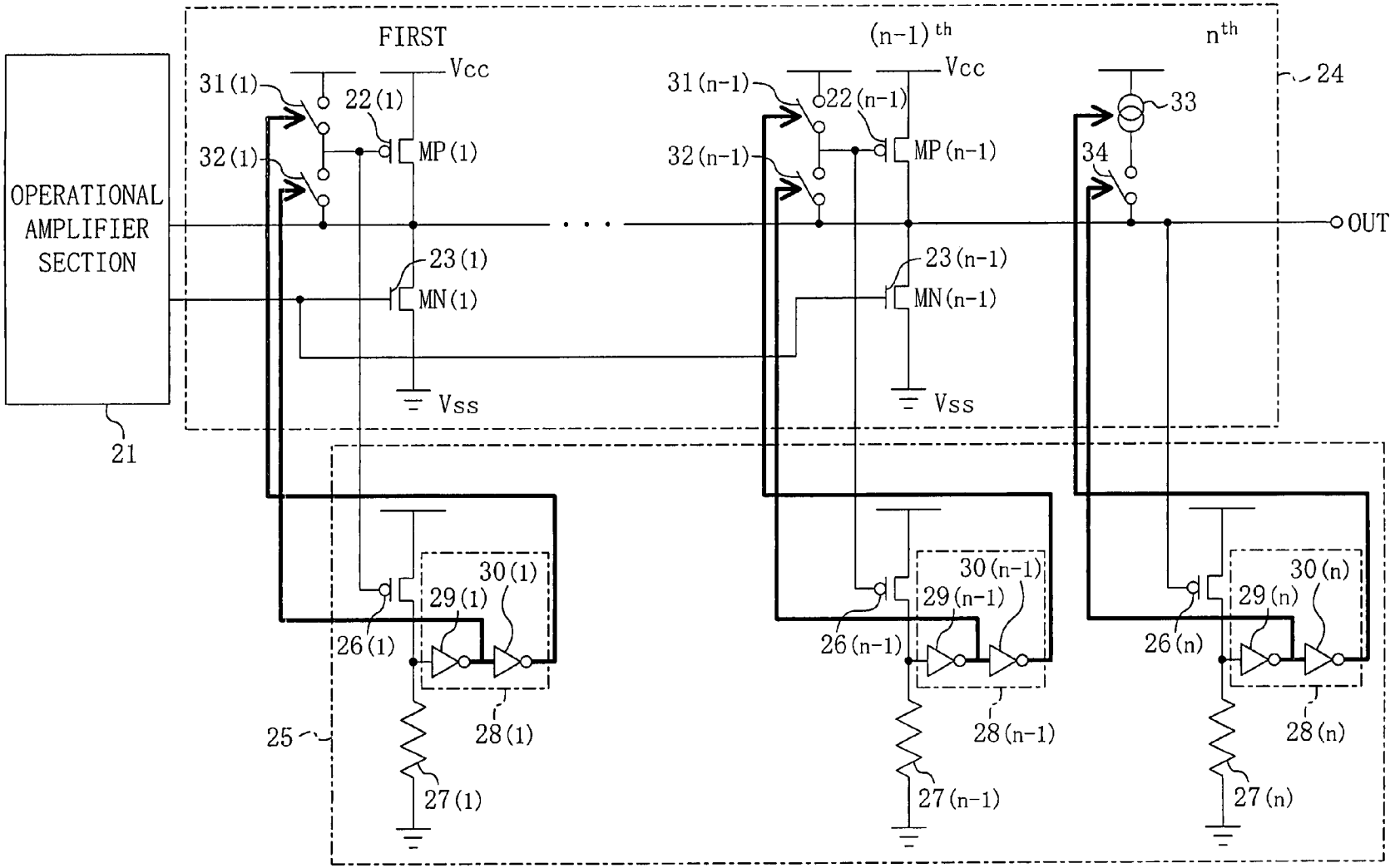
FIG. 5 is a circuit diagram specifically showing a configuration inside a DC-DC power supply of a liquid crystal driver according to a third embodiment.

Hereinafter, a liquid crystal driver and its operation according to a third embodiment of the present invention will be described with reference to drawings. FIG. 5 is a circuit diagram specifically showing a configuration inside a DC-DC power supply of the liquid crystal driver of the third embodiment. Out of the components of the configuration of this embodiment, detailed description of components already described in the second embodiment will be omitted.

As shown in FIG. 5, the DC-DC power supply of this embodiment includes: an operational amplifier section 21; an output transistor section 24 in which p-MIS transistors 22(1) through 22(n−1) and n-MIS transistors 23(1) through 23(n−1) at the first through (n−1)th stages, respectively, are arranged in parallel; and an I-V converter section 25 including n p-MIS transistors 26(1) through 26(*n*). The third embodiment is different from the second embodiment in that a current source 33 is provided at the $n^{th}$ stage in the output transistor section 24, instead of the p-MIS transistor 22(*n*) and the n-MIS transistor 23(*n*) (shown in FIG. 4). The current source 33 is connected to the gate of the p-MIS transistor 26(*n*) via a switch 34.

Now, operation of the liquid crystal driver of this embodiment will be described with reference to FIG. 5.

In the output transistor section 24 and the I-V converter section 25, current from the operational amplifier section 21 flows in the order from the first stage to the $(n-1)^{th}$ stage. In this case, the I-V converter section 25 determines to which stage the current flows out of the first through $n^{th}$ stages, in accordance with the amount of the current.

When a current flows to a p-MIS transistor 22(*a*) and an n-MIS transistor 23(*a*) at a stage (stage a in this case) out of the first through $(n-1)^{th}$ stages, the current also flows into a p-MIS transistor 26(*a*) at stage a in the I-V converter section 25 at the same time. In this case, the p-MIS transistor 22(*a*) and the p-MIS transistor 26(*a*) have the same transistor size, so that the same amount of current flows in these two transistors to reach the input of an inverter section 28(*a*). If the amount of this current is large, the input signal to a first inverter 29(*a*) in the inverter section 28(*a*) is high, the output signal from the first inverter 29(*a*) is low, and the output signal from a second inverter 30(*a*) is high. The low-level output from the first inverter 29(*a*) turns a switch 32(*a*) OFF and the high-level output from the second inverter 30(*a*) keeps a switch 31(*a*) ON, so that current constantly flows in the p-MIS transistor 22(*a*) and the n-MIS transistor 23(*a*).

On the other hand, if the amount of a current flowing into the inverter section 28(*a*) at stage a is small, the input signal to the first inverter 29(*a*) is low, the output signal from the first inverter 29(*a*) is high, and the output signal from the second inverter 30(*a*) is low. The high-level output from the first inverter 29(*a*) turns the switch 32(*a*) ON and the low-level output from the second inverter 30(*a*) turns the switch 31(*a*) OFF, so that no current flows in the p-MIS transistor 22(*a*) and the n-MIS transistor 23(*a*).

At the $n^{th}$ stage in the output transistor section 24, when the output from an inverter 29(*n*) becomes high, the switch 34 turns ON, so that current is supplied from the current source 33 toward a source driver (not shown). Accordingly, if a sufficient amount of current is not obtained with the transistors from the first through $(n-1)^{th}$ stages, the current source 33 operates to supply current to the source driver.

In this embodiment, as in the second embodiment, the amount of current is adjusted at every frame change, thus enabling a large reduction of power consumption.

In addition, the current source 33 provides the following advantages.

For example, to generate current by the DC-DC power supply (shown in FIG. 4) of the second embodiment, it is necessary to charge the gate capacitance ($C_{OX}$) of a high-power transistor provided in the output. Specifically, it is necessary to charge the gate capacitances of the p-MIS transistors 22(1) through 22(*n*) and the n-MIS transistors 23(1) through 23(*n*) at the first through $n^{th}$ stages. To charge the gate capacitance, a time $\tau$ expressed by the following equation (6) is needed.

$$\tau = CR \qquad \text{Equation (6)}$$

(where C=capacitance near an output transistor and R=time constant)

The capacitance C near the output transistor is expressed by the following equation (7):

$$C = C_{OX} + C_C \qquad \text{Equation (7)}$$

(where $C_{OX}$=gate capacitance of the output transistor, and $C_C$=parasitic capacitance of the power line and the output transistor)

On the other hand, in the DC-DC power supply of this embodiment, the current source 33 is provided at the $n^{th}$ stage. Accordingly, if the transistors at the first through $n^{th}$ stages in the output transistor section 24 are driven, current is supplied from the current source 33. The current source 33 starts supplying the current before the gate capacitances of the transistors from the first stage through the $(n-1)^{th}$ stage are completely charged. Accordingly, current is supplied to the source driver quickly, thus enabling high-speed operation. This is especially effective in a case where the image on a liquid crystal panel changes rapidly.

This embodiment is applicable to the case of using any one of class-A, B and AB operational amplifiers.

Embodiment 4

Figure 6B:
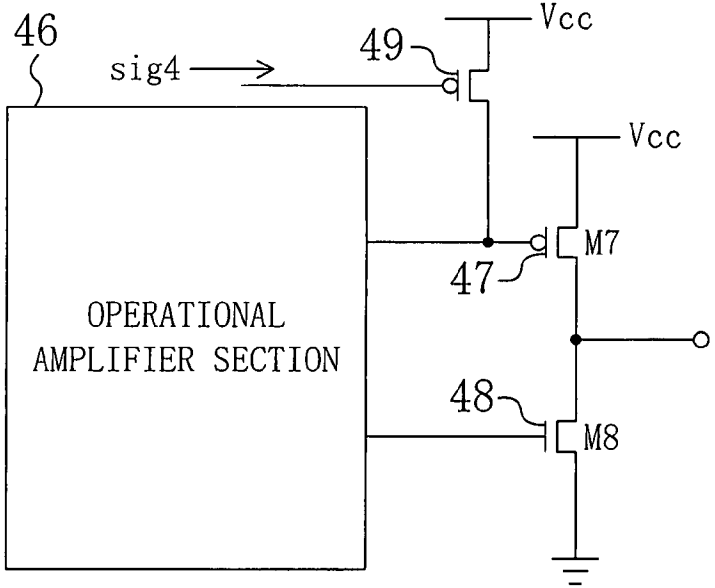
FIG. 6B is a circuit diagram specifically showing a configuration of an operational amplifier in the DC-DC power supply.
Figure 6A:
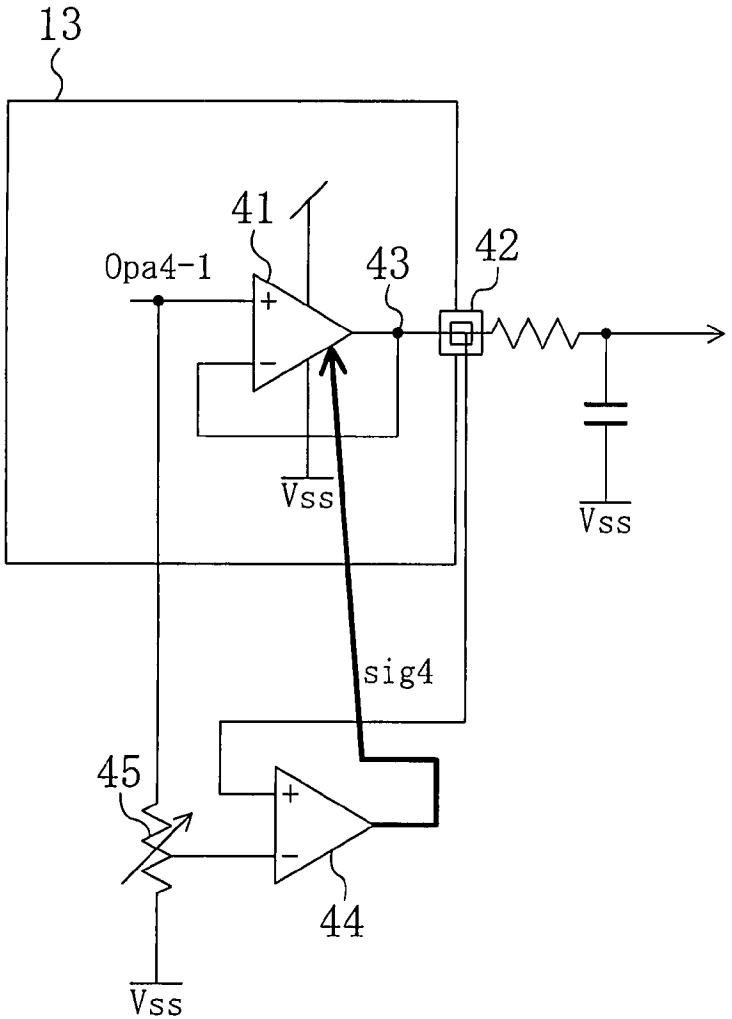
FIG. 6A is a circuit diagram showing a configuration of a DC-DC power supply of a liquid crystal driver according to a fourth embodiment and its surroundings.

Hereinafter, a liquid crystal driver and its operation according to a fourth embodiment of the present invention will be described with reference to drawings. FIG. 6A is a circuit diagram showing a configuration of a DC-DC power supply of the liquid crystal driver of the fourth embodiment and its surroundings. FIG. 6B is a circuit diagram specifically showing a configuration of an operational amplifier in the DC-DC power supply.

As shown in FIG. 6A, the liquid crystal driver of this embodiment includes: a DC-DC power supply 13; and a comparator 44 provided in parallel with an operational amplifier 41 provided in the DC-DC power supply 13.

The output of the operational amplifier 41 is fed back to the input, i.e., negative feedback, via a node 43 between the operational amplifier 41 and an output terminal 42. The (+)-side input of the operational amplifier 41 is connected to the (−)-side input of a comparator 44 via a variable resistor 45. One end of the variable resistor 45 which is not connected to the operational amplifier 41 is grounded. The (+)-side input of the comparator 44 is connected to the output terminal 42.

As shown in FIG. 6B, an operational amplifier section 46, p- and n-MIS transistors 47 and 48 serving as output transistors of the operational amplifier section 46, and a p-MIS transistor 49 for supplying a high/low signal to the gate electrode of the p-MIS transistor 47 are provided in the operational amplifier 41. The gate electrode of the p-MIS transistor 49 is connected to the output of the comparator 44.

Now, operation of the liquid crystal driver of this embodiment will be described with reference to FIGS. 6A and 6B.

In a circuit with a positive power supply, the lower limit of a desired value (standard value) of the output voltage from the operational amplifier section 46 is generally set at $V_x-\alpha$ where $V_x$ is a theoretically-desired value of the output voltage and $\alpha$ is a value which is determined in consideration of the driving temperature and variations among devices. If the output from the operational amplifier is $V_x-\alpha$ or higher, a source driver (not shown) does not operate normally.

In this embodiment, a voltage of $V_x-\alpha$ is applied to the (−)-side input of the comparator 44. The value of $V_x-\alpha$ is obtained by adjusting the value of the variable resistor 45 with the variable resistor 45 interposed between the (+)-side input of the operational amplifier 41 and the (−)-side input of the comparator 44. On the other hand, since the (+)-side input of the comparator 44 is connected to the output terminal 42, the output voltage of the operational amplifier 41 is applied to the (+)-side input of the comparator 44.

The comparator 44 compares $V_x-\alpha$ and the output voltage of the operational amplifier, and outputs a resultant signal Sig4 to the p-MIS transistor 49 in the operational amplifier 41. The p-MIS transistor 49 controls operation of the operational amplifier based on the signal Sig4. Specifically, if the output voltage of the operational amplifier 41 is $V-\alpha$ or higher, operation of the operational amplifier is stopped, whereas if the output voltage of the operational amplifier 41 is lower than $V_x-\alpha$, operation of the operational amplifier is started again.

Hereinafter, effects obtained in this embodiment will be described in comparison with a conventional device.

In a conventional device, irrespective of the amount of a current flowing into the source driver, the operational amplifier always operates. Accordingly, self-power consumption of the operational amplifier is high. It was believed that if the operation of the operational amplifier stops, the output voltage thereof drops.

On the other hand, in this embodiment, if the output from the operational amplifier 41 is within the range of the standard value, the operational amplifier is temporally stopped, thereby reducing power consumption. If the output from the operational amplifier 41 is less than the standard value, the operational amplifier is started again, so that sufficient current is always supplied to the source driver. Accordingly, a stable display is maintained without deterioration in characteristics of the operation of the source driver.

The foregoing description has been made using a power supply for driving a source driver as an example. Alternatively, the present invention is applicable to other power supplies such as power supplies used for a counter electrode and a common electrode. In such a case, power consumption is reduced without a loss of image quality.

In the foregoing description, the positive power supply is used. However, the present invention is applicable to a negative power supply. In such a case, the comparator compares the maximum value $V_x+\alpha$ of the standard value with the output voltage from the operational amplifier. If the output voltage of the operational amplifier is $V_x+\alpha$ or lower, the operational amplifier is stopped, whereas if the output voltage is higher than $V_x+\alpha$, the operational amplifier is operated. Accordingly, power consumption is also reduced without deterioration in characteristics of the display and the like.

This embodiment is applicable to the case of using any one of class-A,. B and AB operational amplifiers.

Embodiment 5

Figure 7A:
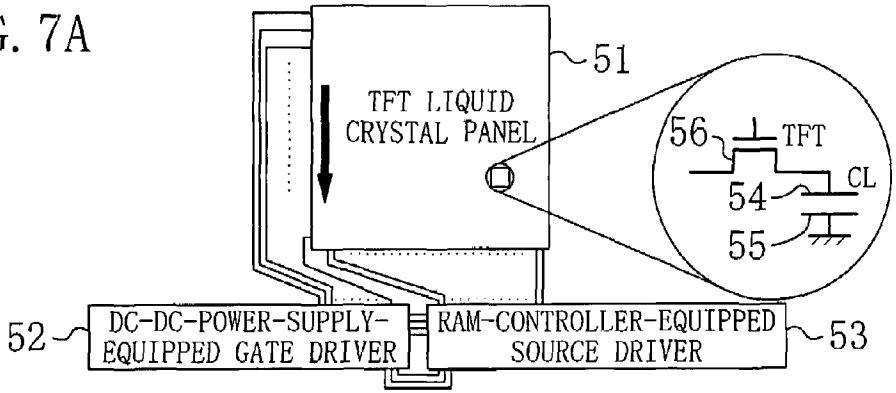
FIG. 7A is a view schematically showing a configuration of a liquid crystal display device according to a fifth embodiment.
Figure 7B:
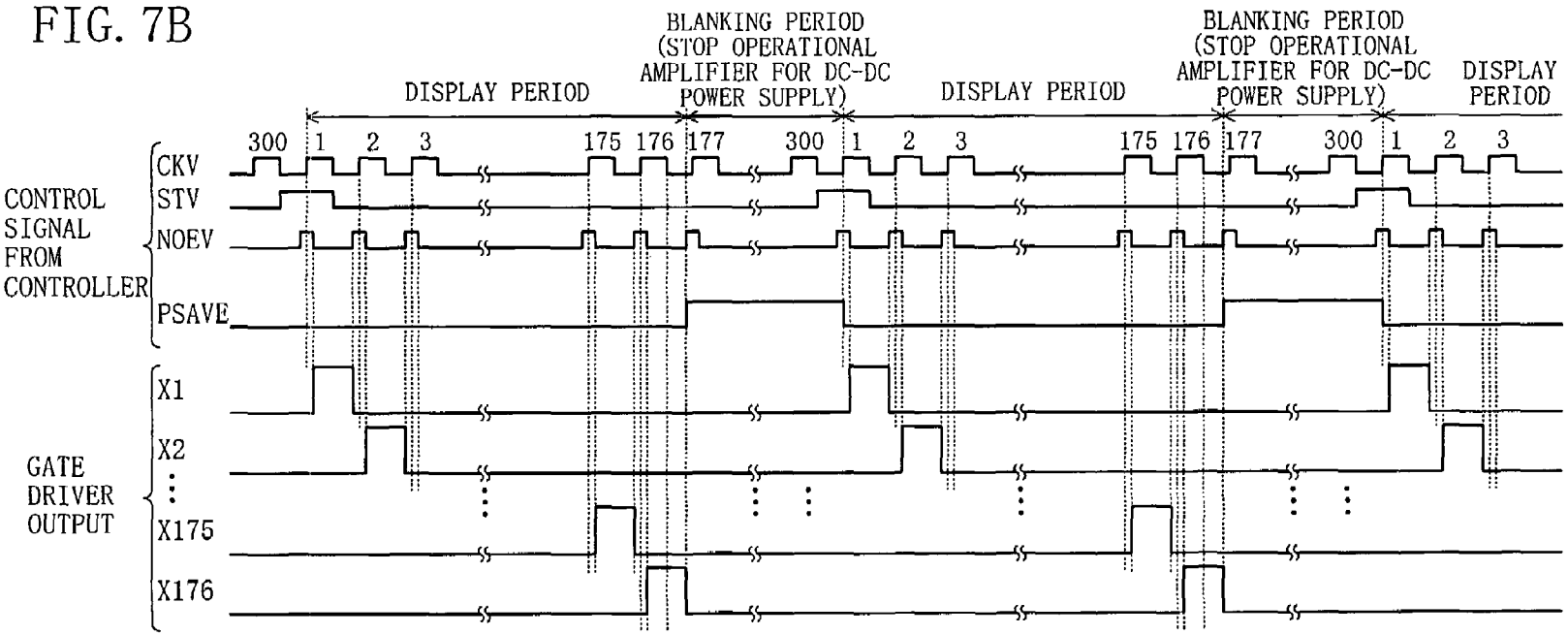
FIG. 7B is a time chart showing operation of the liquid crystal display device shown in FIG. 7A.
Figure 8:
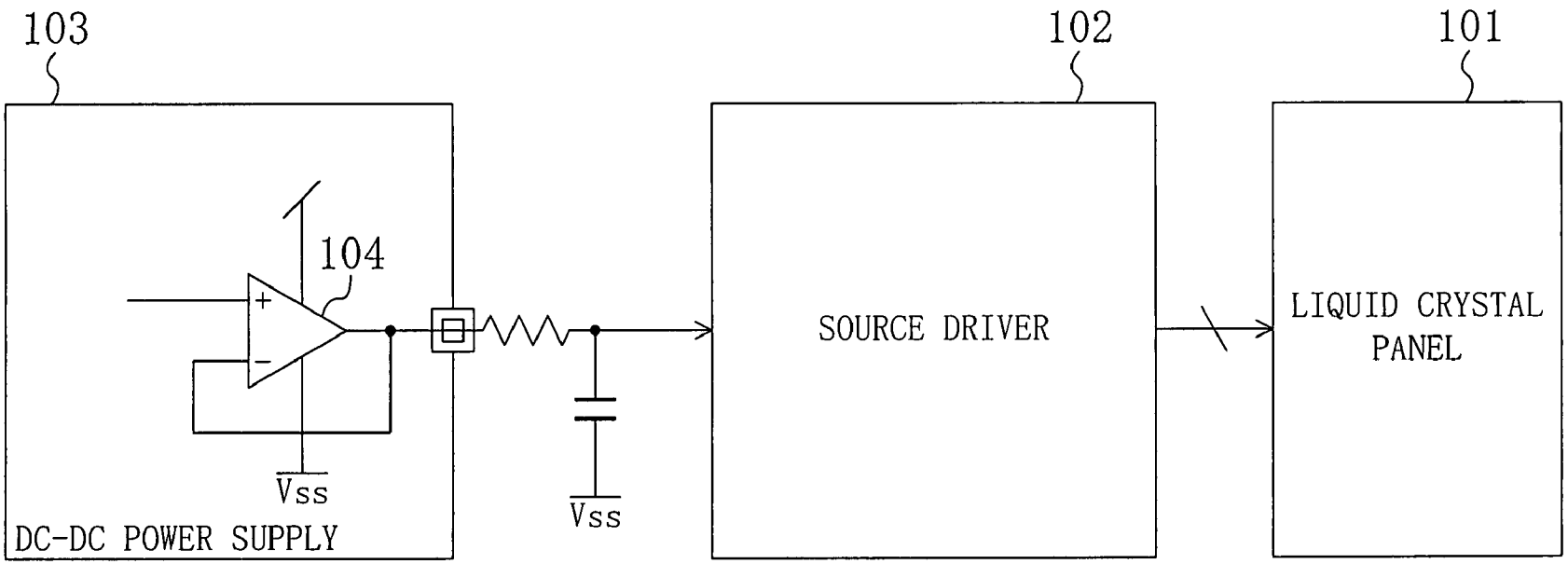
FIG. 8 is a diagram schematically showing a configuration of a conventional liquid crystal display device.

Hereinafter, a liquid crystal driver and its operation according to a fifth embodiment of the present invention will be described with reference to drawings. FIG. 7A is a view schematically showing a configuration of the liquid crystal display device of the fifth embodiment. FIG. 7B is a time chart showing operation of the liquid crystal display device shown in FIG. 7A.

As shown in FIG. 7A, the liquid crystal display device of this embodiment includes: a TFT liquid crystal panel 51; a gate driver 52 equipped with a DC-DC power supply and connected to a gate line (not shown) of the liquid crystal panel 51; and a source driver 53 equipped with a RAM controller and connected to a source line (not shown) of the liquid crystal panel 51.

In the liquid crystal panel 51, an upper electrode 54 and a lower electrode 55 are provided opposed to each other to form a capacitor. The upper electrode 54 is connected to the drain of a thin film transistor (TFT) 56. The source of the TFT 56 receives a voltage from the source driver 53. The gate of the TFT 56 receives a voltage from the gate driver 52. On the other hand, the lower electrode 55 receives a voltage from the DC-DC power supply incorporated in the gate driver 52.

The liquid crystal panel 51 includes source lines (not shown) connected to 132 RGB filters and 176 gate lines.

Although not shown, an operational amplifier for amplifying an input voltage and a booster connected to the operational amplifier are provided in the DC-DC power supply. The booster is provided to boost a reference voltage supplied from the outside and to supply the boosted voltage to the operational amplifier.

Now, operation of a liquid crystal driver according to this embodiment will be described with reference to FIG. 7B.

As shown in FIG. 7B, a clock signal CKV is always supplied from the RAM controller incorporated in the source driver 53 to the DC-DC power supply. At every frame, 300 clocks are supplied to the DC-DC power supply. During the supply from the first clock through the $176^{th}$ clock associated with the $176^{th}$ gate line out of the 300 clocks, image data is written in the liquid crystal panel. This period during which write operation is actually performed in this manner will be referred to as an effective write period. Then, from the $177^{th}$ clock through the $300^{th}$ clock, no image data is written in the liquid crystal panel. This period during which write operation is not actually performed will be referred to as a blanking period.

During the blanking period, the frequency of a clock signal supplied to the booster in the DC-DC power supply is 1/N times (where N=2, 3, 4, . . . ) as high as that during the effective write period.

A signal STV is a signal for controlling the time at which the first clock is input. Specifically, when the blanking period for a frame terminates and the display changes to the next frame, the signal STV is supplied from the controller to the gate driver.

A signal NOEV is a signal for preventing overlapping between the times of inputs of clocks associated with respective gate lines. The signal NOEV is supplied to the gate driver for each of the first through $176^{th}$ clocks.

During the blanking period, a power supply control signal PSAVE is supplied from the controller to the DC-DC power supply. The supply of the power supply control signal PSAVE continues from the rising edge of the $177^{th}$ clock in a frame to the rising edge of the first clock in the next frame. The power supply control signal PSAVE causes the operational amplifier in the DC-DC power supply to stop and to be in a High-Z state.

In this embodiment, during the blanking period, the operational amplifier in the DC-DC power supply is stopped and the frequency of a clock signal supplied to the booster is reduced. Accordingly, power consumption is reduced, as compared to a conventional device in which constant power is supplied even during the blanking period. Hereinafter, this will be described specifically.

In the conventional device, a power consumption P of a DC-DC power supply is expressed by the following equation (8):

$$P=P_{opa}+P_{ch}+P_{etc}+P_{icd} \quad \text{Equation (8)}$$

(where $P_{opa}$=power consumption of the operational amplifier, $P_{ch}$=power consumption of the booster, $P_{etc}$=power consumption of another circuit, and $P_{icd}$=power consumption necessary for charging/discharging the liquid crystal panel)

The power consumption $P_{icd}$ is expressed by the following equation (9):

$$P_{icd}=CVf \quad \text{Equation (9)}$$

(where C=panel capacitance,

V=voltage applied to the panel, and f=frequency of a clock signal supplied to the panel)

On the other hand, in this embodiment, the power consumption P of the DC-DC power supply is expressed by the following equation (10):

$$P=P_{opa}\{(T-t_1)/T\}+P_{ch}\{(T-t_1)/T\}+P_{ch}(t_1/T1)\cdot(1/N)+P_{etc}+P_{icd}\{(T-t1)/T\} \quad \text{Equation (10)}$$

(where T=total period (the sum of the effective write period and the blanking period), $t_1$=blanking period, and 1/N=division ratio of the clock frequency of the booster during the blanking period to the clock frequency of the booster during the effective write period)

In this manner, power consumptions of the operational amplifier and the booster during the blanking period are reduced. Both the operational amplifier and the booster are analog circuits. In the conventional device, the power consumption $P_{opa}$ of the operational amplifier, the power consumption $P_{ch}$ of the booster, and the power consumption $P_{icd}$ necessary for charging/discharging the panel occupy a large part of the total power consumption P of the DC-DC power supply. However, in this embodiment, power consumption of a charging/discharging current in such an operational amplifier, a booster and a panel exhibiting high power consumption is reduced, thus obtaining significant effects. In addition, the operation of the operational amplifier is stopped during the blanking period, so that no drawbacks occur in image quality.

The foregoing description has been made using a power supply for driving a source driver for driving a counter electrode or a common electrode, as an example. Alternatively, the present invention is applicable to other power supplies such as a power supply used for driving a gate driver. In such a case, power consumption is reduced without deterioration in characteristics of the display and the like.

What is claimed is:

1. A liquid crystal display device, comprising:

a display section for displaying an image;

a driver circuit for supplying an output signal for driving the display section;

a controller circuit for supplying, to the driver circuit, a signal for controlling the output signal;

a variation calculator for calculating the amount of change in the signal; and a power supply circuit for supplying, to the driver circuit, power with a value based on the amount of change in the signal, wherein the power supply circuit adjusts the amount of a current supplied to the driver circuit, in accordance with the amount of change in the signal.

2. The device of claim 1, wherein a plurality of pixels are provided in the display section, the driver circuit applies, to the pixels, a voltage depending on the output signal, the variation calculator calculates the amount of change in the signal for each of the pixels, and the power supply circuit supplies, to the driver circuit, a current in an amount proportional to the amount of change in the signal.

3. A power supply circuit, comprising:

an operational amplifier;

an output transistor section including output transistors in a plurality of stages connected to an output of the operational amplifier;

an I-V converter circuit including a transistor forming a current mirror together with an associated one of the output transistors; and a switching circuit for controlling an ON/OFF state of an associated one of the output transistors based on an output signal from the I-V converter circuit, the switching circuit being connected to the I-V converter circuit and the output transistor section.

4. The circuit of claim 3, wherein the I-V converter circuit further includes:

a resistor connected to the transistor in the I-V converter and a ground line; and an inverter section including a plurality of inverters, the inverter section having an input connected between the transistor in the I-V converter and the resistor and an output connected to the switching circuit.

5. The circuit of claim 4, wherein the output transistor section includes, as the output transistors:

p-MIS transistors in the plurality of stages, each of the p-MIS transistors having a gate connected to the output of the operational amplifier and a source connected to a power line; and n-MIS transistors in the plurality of stages, each of the n-MIS transistors having a gate connected to the output of the operational amplifier, a drain connected to a drain of an associated one of the p-MIS transistors, and a source connected to a ground line, and the transistor in the I-V converter circuit is a p-MIS transistor of the same size as that of an associated one of the p-MIS transistors in the output transistor section.

6. The circuit of claim 4, wherein the output transistor section includes, as the output transistors:

pnp bipolar transistors in the plurality of stages, each of the pnp bipolar transistors having a base connected to the output of the operational amplifier and an emitter connected to a power line; and npn bipolar transistors in the plurality of stages, each of the npn bipolar transistors having a base connected to the output of the operational amplifier, a collector connected to a collector of an associated one of the pnp bipolar transistors, and an emitter connected to a ground line, and the transistor in the I-V converter circuit is a pnp bipolar transistor having an emitter of the same size as that of an associated one of the pnp bipolar transistors, which is at the same stage, in the output transistor section.

7. The circuit of claim 3, wherein a current source is connected to the output transistor section.

8. A liquid crystal display device, comprising:

a display section for displaying an image;

a power supply circuit for supplying power for controlling the image on the display section, the power supply circuit including an operational amplifier;

a comparator for comparing an output from the operational amplifier with a standard value; and a switching section for controlling an ON/OFF state of the operational amplifier based on an output signal from the comparator.

9. The device of claim 8, wherein the operational amplifier includes a side input, a (−)-side input and an output, the comparator includes a (+)-side input, a (−)-side input and an output, the (+)-side input of the comparator is connected to the output of the operational amplifier, the (−)-side input of the comparator is connected to the (+)-side input of the operational amplifier, the output of the comparator is connected to the switching section; and a resistor is interposed between the (−)-side input of the comparator and the (+)-side input of the operational amplifier.

10. A liquid crystal display device, comprising:

a display section for displaying an image;

a power supply circuit including an operational amplifier for supplying power for controlling the image on the display section, and a controller circuit for generating a signal for controlling the image on the display section, wherein the operational amplifier is stopped during a blanking period, and the operational amplifier is stopped based on the signal from the controller circuit during the blanking period.

11. The device of claim 10, wherein the power supply circuit further includes a booster for boosting a voltage to be supplied to the operational amplifier, a clock signal is supplied from the controller circuit to the booster, and the frequency of the clock signal in the blanking period is lower than that in an effective write period.

12. The device of claim 10, wherein the display section includes an upper electrode, a lower electrode opposed to the upper electrode, a source line connected to the upper electrode, a gate line connected to the upper electrode, and a transistor connected to both the source line and the gate line, and the liquid crystal display device further comprises:

a source driver for driving the source line, the source driver being connected to the transistor; and a gate driver for driving the gate line, the gate driver being connected to the transistor.

13. The device of claim 12, wherein the power supply circuit supplies the power to either the source driver or the gate driver.

14. The device of claim 12, wherein the power supply circuit supplies the power to the lower electrode.

15. A method for controlling a liquid crystal display device including a display section, a driver circuit for supplying a voltage to the display section, a controller circuit for supplying, to the driver circuit, a signal for controlling the voltage, and a power supply circuit for supplying power to the driver circuit, the method comprising:

a first step of calculating the amount of change in the signal from the controller circuit; and a second step of supplying power from the power supply circuit to the driver circuit based on the amount of change in the signal, wherein in the second step, the amount of a current supplied to the driver circuit is adjusted in accordance with the amount of change in the signal.

16. The method of claim 15, wherein a plurality of pixels are provided in the display section, in the first step, the amount of change in the signal is calculated for each of the pixels, and in the second step, a current in an amount proportional to the amount of change in the signal is supplied to the driver circuit.

* * * * *